United States Patent [19]

Provenzano, Jr.

[11] Patent Number: 4,775,351

[45] Date of Patent: Oct. 4, 1988

[54] WIGGLIN' FISH AMUSEMENT AND NOVELTY DEVICE

[75] Inventor: Victor Provenzano, Jr., Ventura, Calif.

[73] Assignee: Vic's Novelty, Inc., Oxnard, Calif.

[21] Appl. No.: 29,152

[22] Filed: Mar. 23, 1987

[51] Int. Cl.[4] ..... A63H 11/00

[52] U.S. Cl. ..... 446/175; 446/278

[58] Field of Search ..... 446/368, 278, 353, 175, 446/268, 154, 156; 272/8 N, 8 R, 27 N

[56] References Cited

U.S. PATENT DOCUMENTS

| | | | |
|---|---|---|---|
| 2,194,537 | 3/1940 | Adams | 446/368 X |
| 3,119,201 | 1/1964 | Brown et al. | 446/175 |
| 4,236,711 | 1/1980 | Klingbeil | 446/368 X |
| 4,582,317 | 4/1986 | Provenzano, Jr. | 446/390 X |

FOREIGN PATENT DOCUMENTS

| | | | |
|---|---|---|---|
| 237083 | 7/1925 | United Kingdom | 446/353 |

*Primary Examiner*—Mickey Yu

*Attorney, Agent, or Firm*—Rapkin, Gitlin, Moser & Schwartz

[57] ABSTRACT

A fish shaped amusement device that is substantially hollow, includes within the hollow area a sound activated switch, a motor with a self-contained power source and a slightly bent shaft rotatably connected to the motor. A plurality of disc-shaped plates are eccentrically mounted upon the shaft. The shaft and the eccentrically mounted discs, which project into the cavity of the fish along its longitudinal axis and terminate within the portion of the cavity defined by the fish's tail section, engage the inner wall defining the hollow area to impart lifelike movement to the fish.

4 Claims, 1 Drawing Sheet

WIGGLIN' FISH AMUSEMENT AND NOVELTY DEVICE

BACKGROUND OF THE INVENTION

1. Field of the Invention

The present invention is related to an amusement and novelty device and, more particularly, to a simulated fish that includes internal components that combine when activated to impart lifelike movements to various sections of the fish's anatomy.

2. Description of the Prior Art

Novelty and amusement devices of all kinds are disclosed in the prior art, including the invention disclosed and claimed in U.S. Pat. No. 4,582,317, which was issued to applicant. These devices are extremely popular because of their enormous amusement value at social gatherings and as a novelty or specialty gift item. The device of the present invention is particularly appropriate as a gift to a fishing enthusiast to poke fun at the person's inability to "bag" the big one, overzealous commitment to the sport, or the like. However, nothing known to the applicant in the prior art contains the unique combination of elements that are found in the present invention and so closely simulate the appearance and movements of an actual fish fresh out of water.

SUMMARY OF THE INVENTION

The present invention comprises a fish shaped toy that is substantially hollow and contains within the hollow area a switch, a motor and a slightly bent shaft rotatably connected to the motor. A plurality of disc-shaped plates are eccentrically mounted upon the shaft. The shaft and the eccentrically mounted discs project into the cavity of the fish along its longitudinal axis and terminate within the portion of the cavity defined by the fish's tail section. The power source of the invention typically are two (2) 1.5 volt batteries, which are usually contained within the switch housing.

The motor and the attached shaft are held securely in place between the resilient inner walls of the cavity. The switch is located within the cavity adjacent the motor and secured in the same manner. One end of the switch housing is clearly visible at the opening of the mouth of the fish to enable easy access to the control button and for the replacement of batteries.

The switch is utilized to activate the motor which, in turn, causes the bent shaft to rotate inside the cavity. The rotating shaft causes the plates to contact the resilient interior walls of the cavity along the main body portion and the tail section to create the appearance and movements of a fish just fresh out of water and still flailing about.

The device of the present invention may have use, for example, as a toy or as a conversation piece to provide amusement and entertainment at parties and other social gatherings and as a novelty gift for the devoted or maybe not so devoted angler.

It is therefore a primary object of the present invention to provide a novelty and amusement device that simulates the appearance, movements and overall realism of an actual living fish fresh out of water.

Another object of the present invention is to provide a simulated living fish which is more efficient in operation than prior art devices in that it imparts to the fish a more realistic appearance and articulation.

Still another object of the present invention is to provide an amusement and novelty device which is simple and economical to manufacture and use.

Various other objects, features and attendant advantages of the present invention will be more fully appreciated as the same becomes better understood from the following detailed description of the present invention when considered in connection with the accompanying drawings.

DETAILED DESCRIPTION OF THE PREFERRED EMBODIMENT

Figure 1:
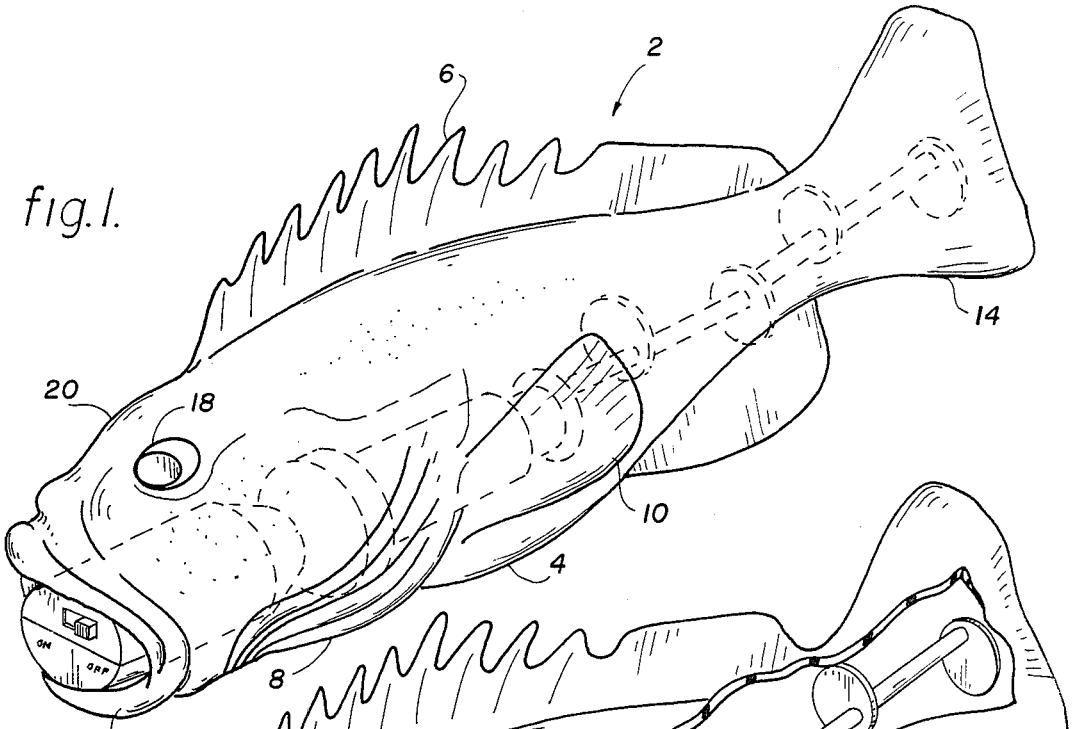
FIG. 1 is a prospective view of the preferred embodiment of the artificial fish in accordance with the present invention.
Figure 2:
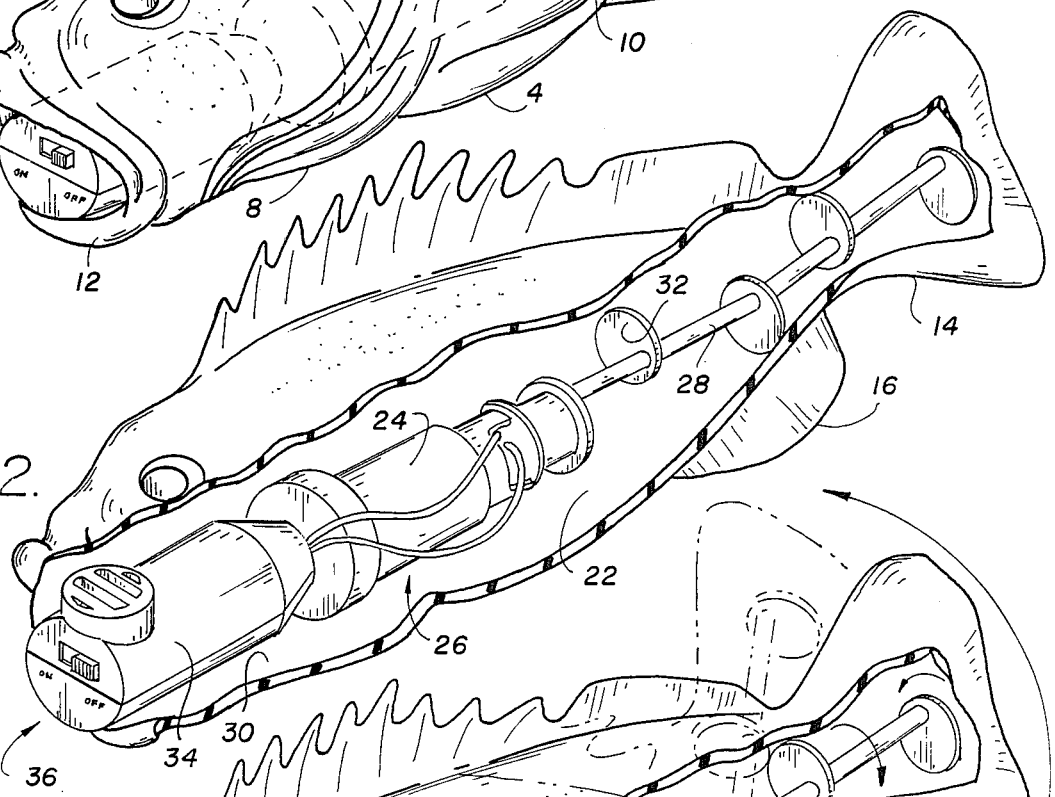
FIG. 2 is a full sectional view of the preferred embodiment of the artificial fish of the present invention shown in FIG. 1 indicating the arrangement of the component parts positioned inside the hollow cavity.
Figure 3:
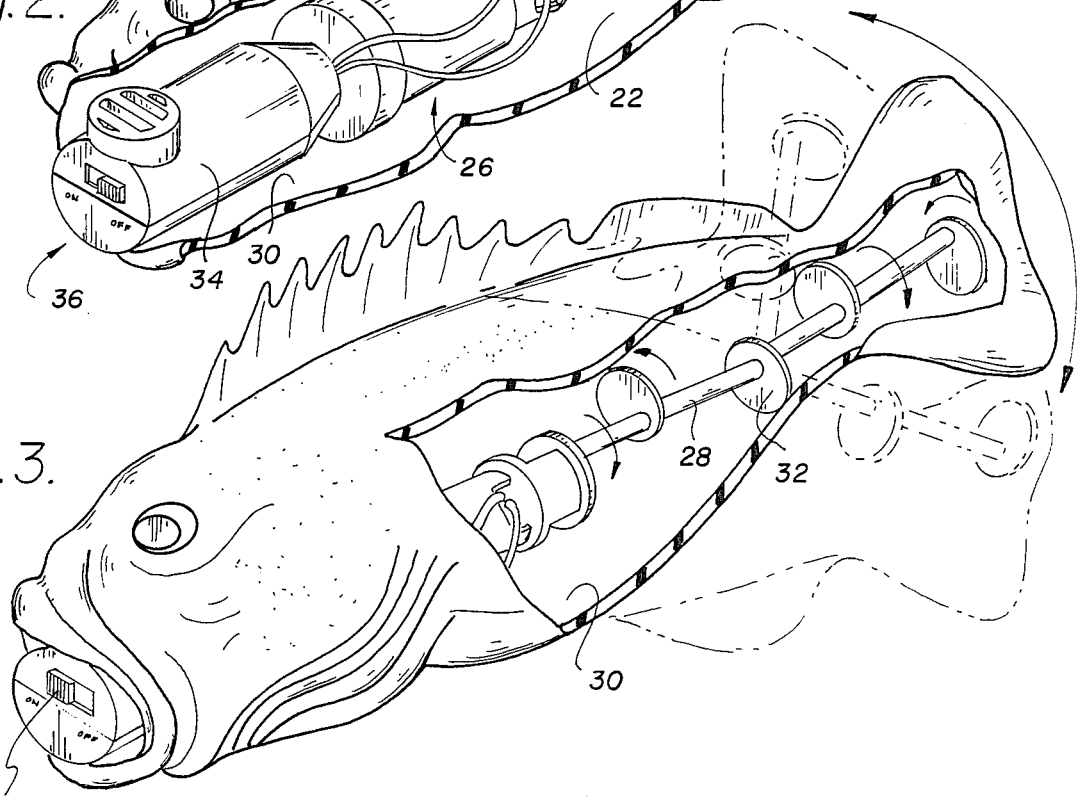
FIG. 3 is a partial sectional view of the preferred embodiment of the artificial fish of the present invention indicating the thrashing motion manifested when the component parts inside the hollow cavity are activated.

Referring to the drawings in FIGS. 1–3, a preferred embodiment of the present invention is shown comprising an artificial fish 2 molded of a suitable synthetic or natural material, such as rubber or a deformable resilient plastic. Fish 2 includes the main body section 4, dorsal fin 6, gills 8 and 10, mouth 12, tail section 14, lower fin 16 and eyes 18 and 20. Fish 2 is essentially a hollow or shell-like structure having a cavity 22 for accommodating a motor 24, which may be of any suitable conventional design. Motor 24 drives a flexible rotary shaft 28 which is slightly bent and projects axially through cavity 22 into the hollow defined by tail section 14. Motor 24 is secured and held tightly within motor mount 26 to ensure a predictable alignment of the rotary shaft 28 and articulation of the anatomy of fish 2. Motor mount 26 is held securely within cavity 22 between portions of inner wall 30. Eccentrically mounted upon shaft 28 are a plurality of spaced discs 32. Switch 34 is contained within switch housing 36, which is positioned immediately adjacent to motor 24 and securely held within cavity 22 between portions of its inner wall 30. One end of housing 36 is exposed at the opening of mouth 12 to enable easy and immediate access to control button 38 and the batteries (not shown), which are contained in switch housing 36 and serve as the power source for motor 24.

In the operation of the present invention, fish 2 may be placed on any suitable surface and activated to articulate the appearance and mild thrashing motion of a fish fresh out of water and tiring from the lack of oxygen. The greater the amount of friction that develops between the external body surface of fish 2 and the surface it is placed upon, the more distinct the movements and, thus, lifelike the fish will appear. As an alternative, fish 2 may be permanently mounted upon a wooden board or similar display vehicle and activated manually by using the control button 38 or the clap of a hand or similar gesture to trigger a sound activated switching mechanism. The use of the self-contained components, including switch 34, motor 24 and shaft 28, eliminates the need for cumbersome control boxes and the unsightly and usually disorderly looking electrical wires which would undoubtedly detract from the otherwise lifelike appearance of the device.

Numerous modifications and variations of the present invention are possible in light of the above teachings. It is therefore to be understood that within the scope of the appended claims, the invention may be practiced otherwise than as specifically described herein.

What is claimed is:

1. An amusement device comprising a simulated fish, including:

a. an elongated hollow body, including a head section containing an opening at the mouth, and a tail section;

b. an inner wall defining the hollow section within the body;

c. a motor;

d. a sound activated switch means;

e. a bent shaft rotatably connected to and driven by said motor;

f. a source of power;

g. means mounted upon said shaft to engage said inner wall when said bent shaft is activated by said motor to impart lifelike movement to the body of said fish; and, h. a generally cylindrical shaped housing means for containing said sound activated switch means and said power source connected thereto, said housing means, which includes a control end, a receiver means through which to receive sound emissions and a front end, and is insertable within said hollow body and generallly aligned along its longitudinal axis with the respective longitudinal axes of said motor and said shaft, said motor and shaft being positioned within said hollow body and extending therethrough from said front end to said tail section.

2. The invention of claim 1 wherein said means mounted upon said shaft comprises a plurality of disc-shaped plates eccentrically mounted upon said shaft.

3. The invention of claim 1 wherein said power source is electrical.

4. The invention of claim 3 wherein said electrical power source is housed adjacent to said switch means.

* * * * *